US006817910B2

(12) United States Patent
Borgstrom et al.

(10) Patent No.: US 6,817,910 B2
(45) Date of Patent: Nov. 16, 2004

(54) THERMOPLASTIC MOLDED SET SCREW CONNECTOR ASSEMBLY

(75) Inventors: Alan D. Borgstrom, Hackettstown, NJ (US); Kieran Higgins, Great Meadows, NJ (US)

(73) Assignee: Thomas & Betts International, Inc., Sparks, NV (US)

( * ) Notice: Subject to any disclaimer, the term of this patent is extended or adjusted under 35 U.S.C. 154(b) by 0 days.

(21) Appl. No.: 10/734,786

(22) Filed: Dec. 12, 2003

(65) Prior Publication Data

US 2004/0142588 A1 Jul. 22, 2004

Related U.S. Application Data

(63) Continuation of application No. 10/265,210, filed on Oct. 4, 2002, now Pat. No. 6,688,921.
(60) Provisional application No. 60/328,372, filed on Oct. 10, 2001.

(51) Int. Cl.[7] ..... H01R 11/09
(52) U.S. Cl. ..... 439/798; 439/136; 439/596; 439/587
(58) Field of Search ..... 439/798, 797, 439/937, 590, 135, 596, 587, 136, 447, 445

(56) References Cited

U.S. PATENT DOCUMENTS 3,774,141 A 11/1973 Condon
3,792,415 A 2/1974 Fuller
4,629,268 A 12/1986 Hiles
4,671,587 A 6/1987 Lerner et al.
D309,664 S 7/1990 McGrane
D346,150 S 4/1994 Triantopoulos
5,542,852 A 8/1996 Hsueh
D377,782 S 2/1997 Fillinger
5,643,009 A 7/1997 Dinkel et al.
5,690,516 A 11/1997 Fillinger
5,823,817 A 10/1998 Pyle
5,848,913 A 12/1998 Ashcraft
5,931,708 A 8/1999 Annas et al.
6,017,243 A 1/2000 Castaldo
6,764,354 B2 * 7/2004 Kaine et al. ..... 439/793

* cited by examiner

*Primary Examiner*—Gary Paumen
(74) *Attorney, Agent, or Firm*—Hoffmann & Baron, LLP

(57) ABSTRACT

A set screw connector includes an elongate generally rectangular conductive bus bar. The bus bar includes a first face having a plurality of spaced cable receiving apertures and a second face which is generally orthogonal to the first face having a plurality of spaced set screw apertures. The cable receiving apertures and the set screw apertures are in communication with one another. A cover formed of a thermoplastic elastomer (TPE) is molded over the bus bar. The molded cover further includes integrally formed auxiliary components insertable into at least one of the cable receiving apertures and the set screw receiving apertures.

15 Claims, 5 Drawing Sheets

THERMOPLASTIC MOLDED SET SCREW CONNECTOR ASSEMBLY

CROSS REFERENCE TO RELATED APPLICATION

This application is a continuation of U.S. application Ser. No. 10/265,210, filed Oct. 4, 2002 now U.S. Pat. No. 6,688,921, which claims priority to Provisional Application Ser. No. 60/328,372, filed Oct. 10, 2001.

FIELD OF THE INVENTION

The present invention relates generally to a set screw connector for connecting electrical conductors. More particularly, the present invention relates to a submersible set screw connector assembly having a thermoplastic insulator overmolded about a machined bus bar in an integral unit.

BACKGROUND OF THE INVENTION

Use of insulated bus bar connectors for making electrical connections between power conductors is well known. These connectors include a machined bus bar formed of metallic material having apertures or ports arranged at right angles for insertably accommodating the ends of electrical conductors and set screws which secure the conductors thereto. The machined bus bar includes a thermoset rubber compound injected therearound as an insulated covering. The covering protects against accidental contact with the energized bus bar. Further, as certain of these connectors are designed for underground or submersible use, the cover may be a watertight EPDM rubber or similar thermoset rubber compounds. An example of such a connector is shown in U.S. Pat. No. 5,848,913.

A conventional set screw connector 10 is shown in FIG. 1. Set screw connector 10 includes an insulative coating or cover 12 which surrounds a substantially rectangular metallic bus bar body 14. Cover 12 includes tubular extensions 16 projecting from a front face so as to access apertures in the bus bar for receiving electrical conductors inserted therein. The cover further includes set screw extensions 18 extending at right angles from conductor extensions 16, which themselves access apertures in the bus bar 12 which are in communication with the conductor apertures so as to allow accommodation of a set screw therein to secure the conductors in mechanical and electrical engagement, as is well known in the art. Typically, the cover 12 of set screw connector 10 is formed by injecting an EPDM rubber compound around the machined bus bar.

As is common with set screw connectors, various auxiliary components, such as set screws, sealing plugs used to cap set screw apertures, and cable adaptors used to accommodate a range of cable sizes, are separately supplied with the set screw connector. These auxiliary components must be separately manufactured and formed. Furthermore, these components must be separately packaged and supplied. This is due, in part, to the thermoset rubber compound that is employed. Use of such thermoset compounds prevents the components of the set screw connector for being manufactured in a single process. Thus, the existing manufacturing processes used for manufacturing such submersible low voltage set screw connectors are time-consuming and costly.

It is desirable to provide a submersible low voltage set screw connector which allows for combining the auxiliary components with the set screw connector in a compact design.

SUMMARY OF THE INVENTION

The present invention set screw connector for accommodating and connecting a plurality of electrical cables. The set screw connector includes an elongate generally rectangular conductive bus bar having a first face including a plurality of spaced apart cable receiving apertures. The second face of the bus bar which is generally orthogonal to the first face includes a plurality of spaced set screw receiving apertures. The cable receiving apertures are in communication with the set screw receiving apertures.

A cover formed of thermoplastic elastomer (TPE) is molded over the bus bar. The cover includes integrally molded therewith a plurality of auxiliary components. The auxiliary components are insertable to at least one of cable receiving apertures in the set screw receiving apertures.

In a preferred embodiment of the present invention, the auxiliary components may include cable size adapters which are insertable into the cable receiving apertures to provide for accommodation of different size cables. Furthermore, the auxiliary components may include sealing plugs which may be inserted into the set screw receiving apertures. Additionally, the cover may include an integrally attached tether for supporting the auxiliary components. The cable size adapters may be detached from the tether for insertion into the cable receiving apertures. The set screw plugs are arranged so that they may be inserted into the set screw apertures while still attached to the tether.

DETAILED DESCRIPTION OF THE PREFERRED EMBODIMENTS

The present invention provides a submersible low voltage set screw connector assembly where the machined bus bar forming the connector is overmolded with a thermoplastic elastomer in a process which also forms therewith the auxiliary components used in combination with the set screw connector.

Figure 1:
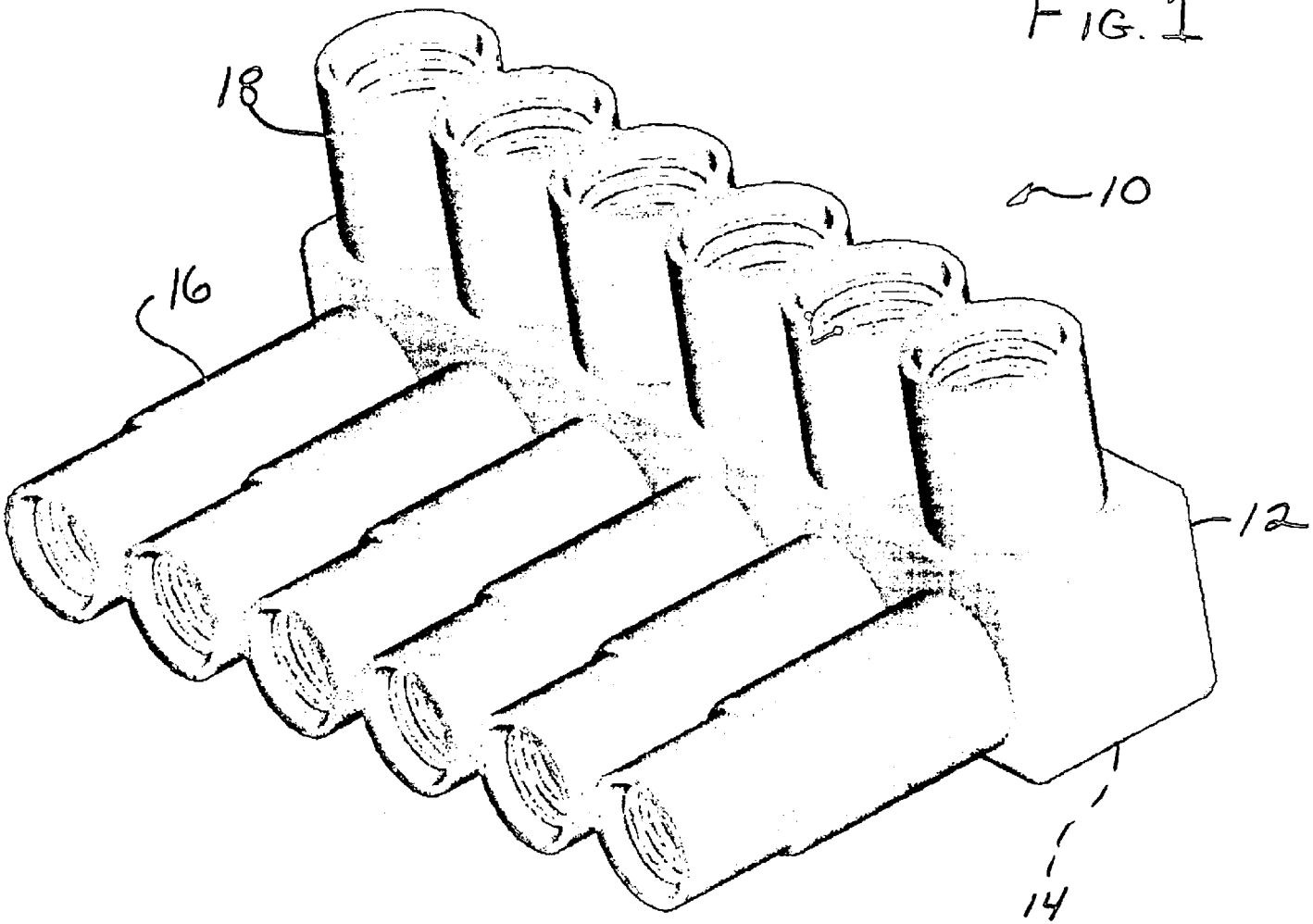
FIG. 1 is a perspective showing of a prior art submersible set screw connector.
Figure 2:
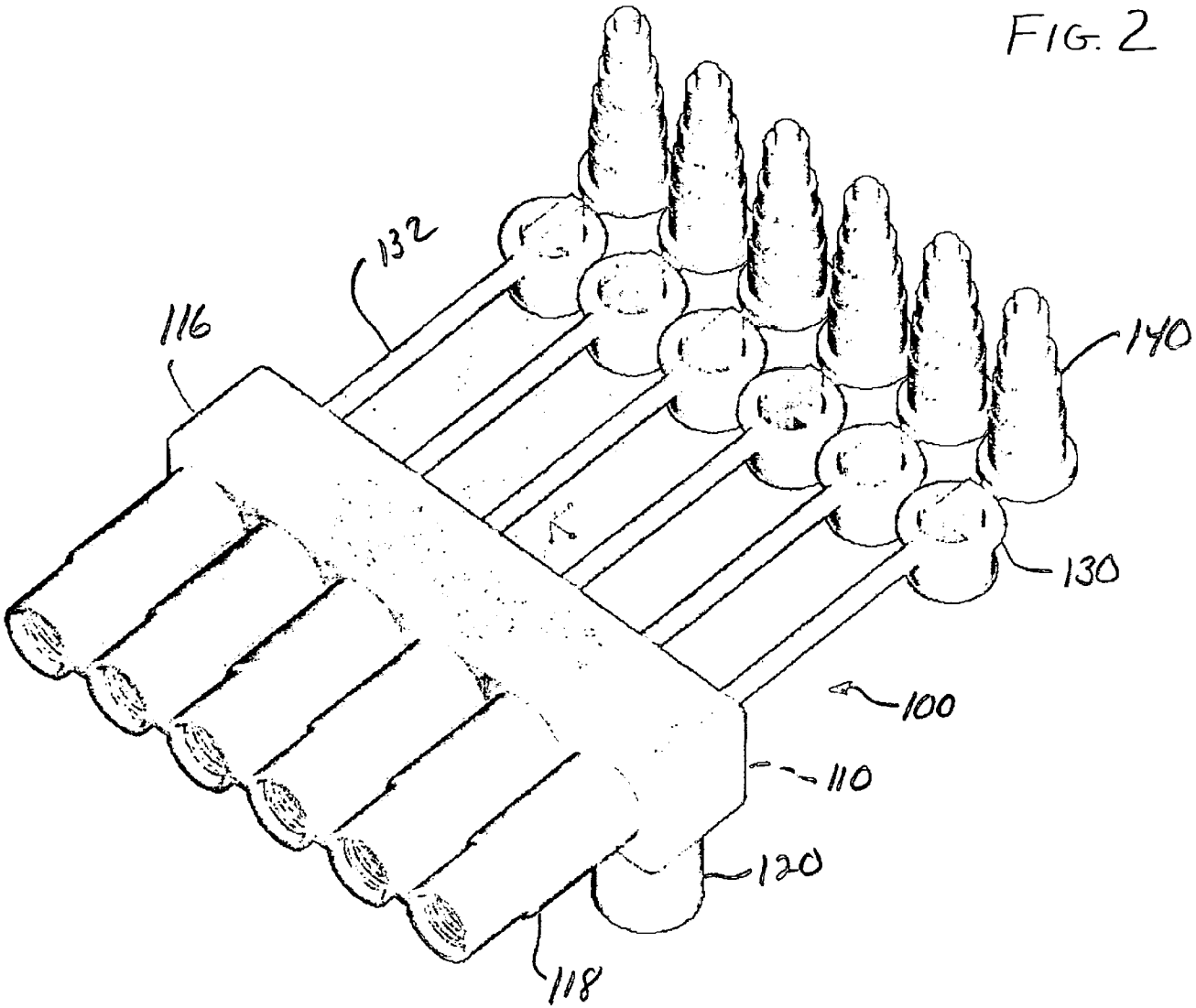
FIG. 2 is a perspective showing of the submersible set screw connector of the present invention.
Figure 3:
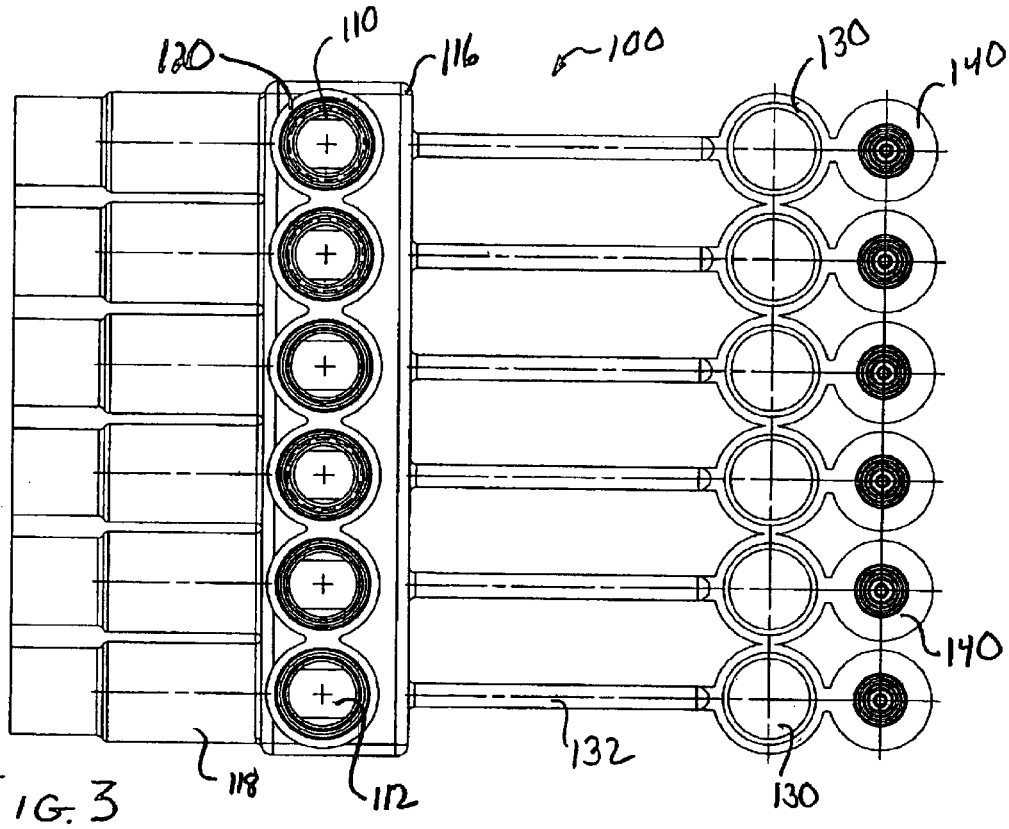
FIGS. 3, 4 and 5 show top, side and bottom plan views, respectively, of the submersible set screw connector assembly of FIG. 2.
Figure 4:
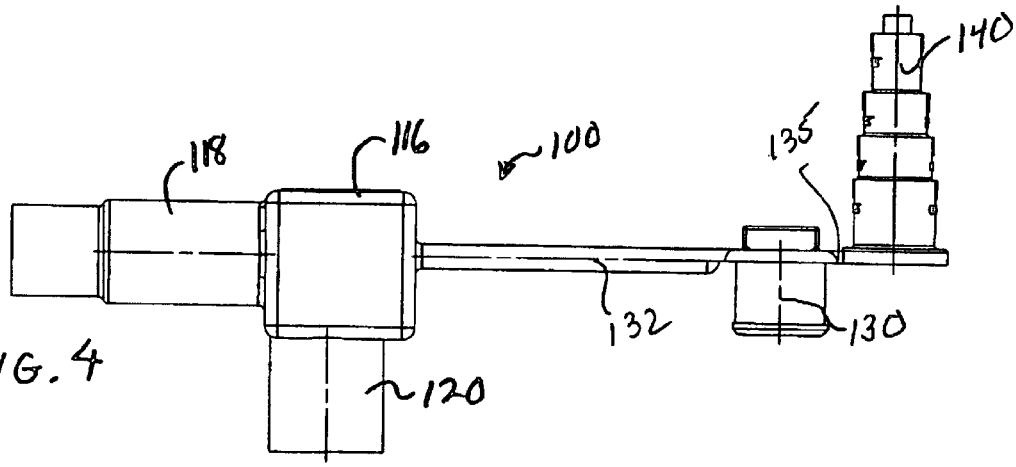
Figure 5:
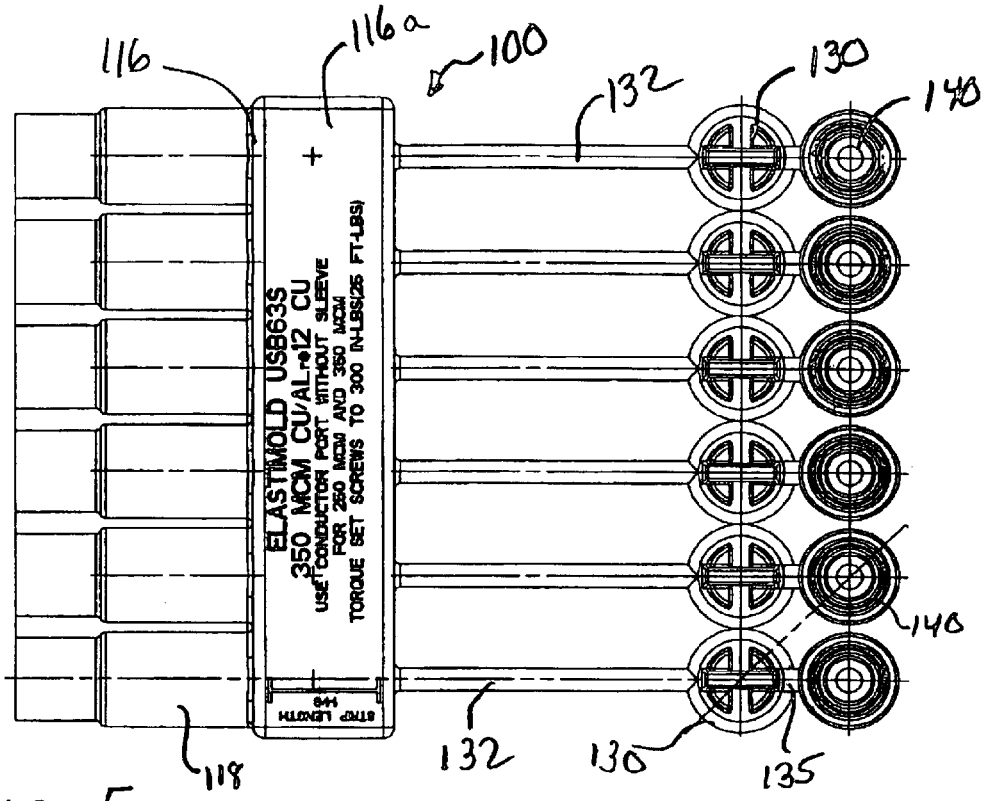
Figure 6:
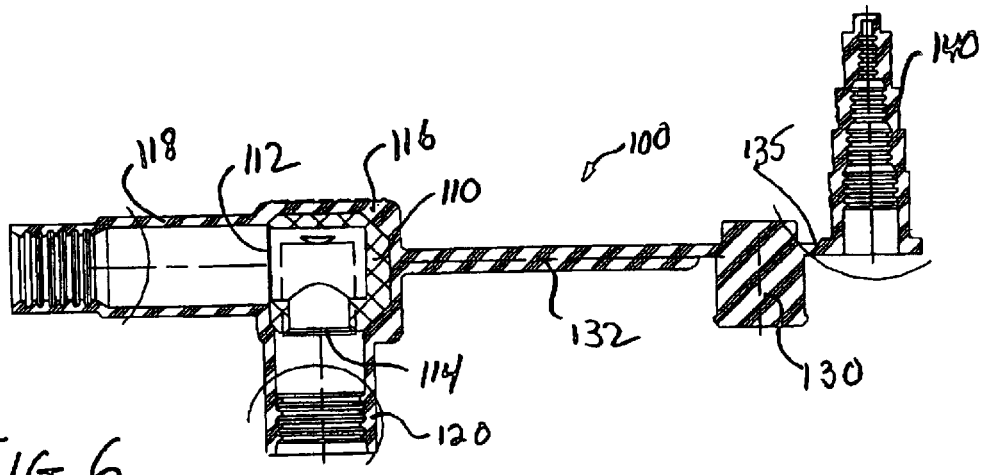
FIG. 6 is a horizontal cross-sectional view of the set screw connector of FIG. 2.

As set forth in FIGS. 2–7, the set screw connector assembly 100 of the present invention is shown. The connector assembly 100 includes a generally rectangular bus bar body 110 formed of machined conductive metal (FIG. 6). The bus bar body 110 has a plurality of conductor receiving apertures 112 along one face, and a plurality of set screw receiving apertures 114 along a second face orthogonal to the first face and in communication with the conductor apertures 112.

The body 110 includes an insulative coating or cover 116 in substantially surrounding relationship. The covering 116 is molded thermoplastic elastomer (TPE) that combines the properties of thermoplastic with the performance characteristics of a thermoset rubber. These materials allow for decreased molding cycle time and improve repeatability. These materials are more efficient to manufacture in that the molding process does not require the constant attention formerly associated with the use of thermoset rubbers.

The assembly 100 is molded to include tubular extensions 118 extending from the metallic bus bar adjacent conductor receiving apertures 112. Extensions 118 each accommodate the insertion of a conductor (not shown) therein. The cover 110 also includes set screw extensions 120 extending from set screw apertures 114. The set screw apertures 114 and set screw apertures 120 accommodate preassembled set screws (not shown) for securing the connector in the conductor apertures 112.

The ability to mold the cover out of a thermoplastic elastomer enables the molding process to further form auxiliary components in one integrally formed unit. The cover 110 may be molded with certain auxiliary components such as sealing plugs 130 which are each attached to the bus bar by an elongate cord or tether 132 and cable size adaptors 140 which are formed adjacent sealing plugs 130. The sealing plugs 130 are molded directly to the distal end of the tether 132. The cable size adapters 140 are molded distally adjacent the sealing plugs 130. The cable size adapters 140 are frangibly connected by an integrally molded web 135.

The assembly 100 is supplied as a single-package unit where in the field, the cable size adaptors 140 may be severed from the sealing plugs 130 at web 135 and used in a conventional fashion to effect proper insertion of an appropriately sized cable. The tether 132 is molded to include web 135 allowing for detachment of the adaptors 140 therefrom.

Figure 7:
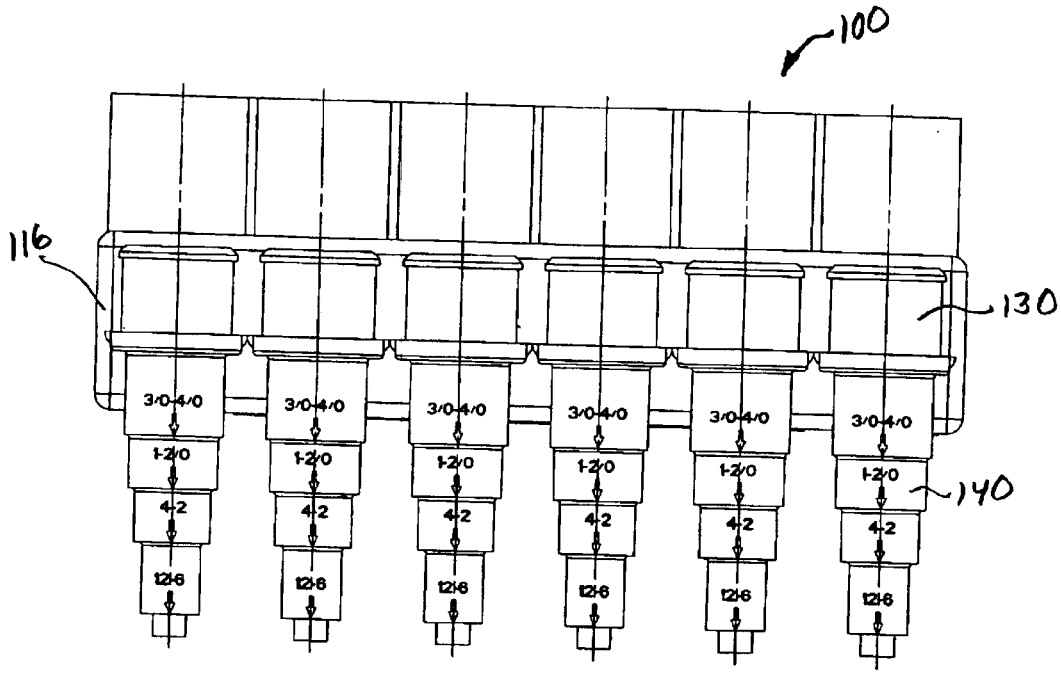
FIG. 7 is a rear plan view of the set screw connector of FIG. 2.

As shown in FIG. 5, the cable size adapters 140, when positioned within cable extensions 118 allow proper accommodation of different sizes of conductors. As shown in FIG. 7, cable size adapters may include markings molded thereon to identify the proper conductor range accommodated by the corresponding sections thereof.

The sealing plugs 130 may be inserted into the set screw extensions 120 after the preassembled set screws have been tightened by the user to secure the conductor in the bus bar. This seals the set screw apertures. The tethers 132 allow the sealing plugs to be inserted into the set screw extensions while still tethered.

The ability to mold the assembly in a single package decreases the chances of loss of the auxiliary components in the field. It also ensures that at the time of installation, all of the necessary components will be available to the installer.

Furthermore, as shown in FIG. 5, much of the necessary basic installation and measurement information is molded into the covering and the auxiliary components to provide the information to the technician without need for reference to separate installation instructions. As mentioned above, such information may include cable range guides and score marks on the cable adapters. Also, one face 116*a* of the cover over the bus bar may include catalog information, a guide for stripping the conductor, cable ranges as well as torque requirements. Again, this provides the technician with the ability to have all necessary components as well as instructions on hand in one unit. This helps reduce installation error and reduces installation time and cost.

Various changes to the foregoing described and shown structures will now be evident to those skilled in the art. Accordingly, the particularly disclosed scope of the invention is set forth in the following claims.

What is claimed is:

1. A set screw connector for accommodating electrical cable comprising:

an elongate generally rectangular conductive bus bar having a first face having a plurality of spaced cable receiving apertures and a second face generally orthogonal to said first face have a plurality of spaced set screw receiving apertures, said cable receiving apertures being in communication with said set screw receiving apertures; and a cover formed of thermoplastic elastomer (TPE), and molded over said bus bar, said molded cover further including at least one integrally formed auxiliary component insertable into at least one of said cable receiving apertures or at least one of said set screw receiving apertures.

2. A set screw connector of claim 1 wherein said cover includes a plurality of integrally formed said auxiliary components.

3. A set screw connector of claim 2 wherein said plurality of said auxiliary components are insertable into said cable receiving aperatures and said set screw apertures.

4. A set screw connector of claim 1 wherein said at least one auxiliary component is integrally attached by an integrally formed tether.

5. A set screw connector of claim 2 wherein said at least one is auxiliary component is detachable from said tether.

6. A set screw connector of claim 3 wherein said plurality of said auxiliary components include plural elongate generally tubular cable size adapters, said cable size adapters are detachable from said tether for insertion into said cable receiving apertures.

7. A set screw connector of claim 4 wherein said plurality of said auxiliary components further include plural sealing plugs for closing said set screw apertures.

8. A set screw connector of claim 7 wherein said cover includes set screw extensions adjacent to and rendering accessible said set screw apertures, and sealing plugs being received into said set screw extensions.

9. A set screw connector of claim 5 wherein said cover includes tubular cable extensions adjacent to and rendering accessible said cable receiving apertures.

10. A set screw connector of claim 9 wherein said cable size adapters are insertable into said tubular cable extensions.

11. A method of manufacturing a set screw connector comprising the steps of:

providing an elongate conductive generally rectangular bus bar, said bus bar having a first face including a plurality of cable apertures therein and a second face orthogonal to said first face having a plurality of set screw apertures therein; and molding a covering member over said bus bar, said covering member including a bus bar cover and at least one integrally formed auxiliary component for insertion into at least one of said cable receiving apertures or at least one of said set screw apertures.

12. A method of claim 11, wherein said molding step further includes:

integrally molding a tether interconnecting said at least one auxiliary component and said bus bar cover.

13. A method of claim 12, wherein said molding step further includes: detachably molding said at least one auxiliary component to said tether.

14. A method of claim 13, wherein said cable includes a plurality of said auxiliary components, said plurality of said auxiliary component including:

sealing plugs for insertion into said set screw adapters; and cable size adapters for insertion into said cable receiving apertures.

15. A method of claim 14, wherein said cable size adapters are detachable from said tether.

* * * * *